US005475908A

United States Patent [19]

Scherpf et al.

[11] Patent Number: 5,475,908

[45] Date of Patent: Dec. 19, 1995

[54] DEVICE FOR ENTANGLEMENT OF FILAMENTS IN A MULTIFILAMENT YARN

[75] Inventors: Hans-Dieter Scherpf; Hans Hermanns, both of Hammelburg, Germany

[73] Assignee: Temco GmbH & Co. KG, Germany

[21] Appl. No.: 272,132

[22] Filed: Jul. 8, 1994

[30] Foreign Application Priority Data

Jul. 10, 1993 [DE] Germany ..... 43 23 131.4

[51] Int. Cl.[6] ..... D02G 1/16

[52] U.S. Cl. ..... 28/272

[58] Field of Search ..... 28/271, 272, 273, 28/274, 275, 276; 57/333, 350

[56] References Cited

U.S. PATENT DOCUMENTS

| | | | |
|---|---|---|---|
| 4,592,119 | 6/1986 | Bauer et al. | 28/271 |
| 4,644,622 | 2/1987 | Bauer et al. | 28/271 |
| 4,936,000 | 6/1990 | Nabulon et al. | 28/272 |
| 4,941,242 | 7/1990 | Nabulon | 28/272 |
| 5,146,660 | 9/1992 | Ritter | 28/272 |
| 5,184,381 | 2/1993 | Coons et al. | 28/271 |

FOREIGN PATENT DOCUMENTS

| | | |
|---|---|---|
| 3523711 | 10/1986 | Germany . |
| 3727262 | 2/1989 | Germany . |

*Primary Examiner*—C. D. Crowder
*Assistant Examiner*—Larry D. Worrell, Jr.
*Attorney, Agent, or Firm*—Ostrolenk, Faber, Gerb & Soffen

[57] ABSTRACT

In entangling nozzles for entangling a plurality of filaments, a device is proposed which can be integrated into warping systems or the like, in which the entangling nozzles are arranged on a traverse which is movable with respect to the air-feed beam, the movement of the traverse taking place manually or pneumatically, against compression springs connected to the entangling nozzle. In this connection, the baffle plates are fastened, fixed in position, by a holder, for instance on the air-feed beam. Thus the entangling nozzles are opened for thread insertion by moving the traverse, and with it the entangling nozzle, away from the fixed baffle plate. By such movement the air feed may also be cut off.

16 Claims, 6 Drawing Sheets

DEVICE FOR ENTANGLEMENT OF FILAMENTS IN A MULTIFILAMENT YARN

BACKGROUND OF THE INVENTION

The present invention relates to a device for entangling filaments in a multifilament yarn, and more particularly to a device having a plurality of entangling nozzles for entangling the filaments with compressed air, the compressed air being fed via an air-feed beam to the entangling nozzles and the nozzles being closed by a baffle plate.

When drawing multifilament yarns of thermoplastic materials, such as polyamides, polyester, polypropylene, and polyethylene, particularly in connection with the drawing and warp beaming of such yarns, it is desirable for the yarns to be subjected to air entanglement before or after the drawing operation. Generally, an air jet is directed perpendicularly at each running yarn. The individual filaments are moved about by the air jet, contact each other, and thereby receive a certain cohesion among themselves. This process is generally referred to as interlacing or "entangling."

One entanglement process and a known entangling apparatus are described generally in U.S. Pat. No. 5,184,381, which corresponds to EP 488,070-A1.

Other devices for use in warping systems, draw-warping systems and warping frames, wherein a large number of multifilament yarns must be entangled simultaneously, are disclosed in EP 0 152 919 B1 (corresponding to U.S. Pat. Nos. 4,592,119 and 4,644,622) and DE 37 27 262 A1.

In the known devices, self-contained entangling nozzles are predominantly used. They generally have the shape of either a small tube, or a plate or block within which a thread channel is arranged. They are generally fastened directly to the air-feed beam.

In addition, turnable entangling nozzles are known, which can be opened on one side for the insertion of the thread and then turned to a closed position. In these turntable entangling nozzles it is possible, by the turning process, to shut off the compressed air during the threading process, but each entangling nozzle must be operated individually.

The threading process is very cumbersome, time-consuming and complicated in all the known devices and, as has been discovered in practice, must be repeated frequently. There is no assurance of dependable insertion of the thread. Furthermore, the feeding of the air, which must begin directly after the threading process and the starting of the thread, takes place in such devices at different time intervals and thereby leads to a poorer quality of the yarn. In a warping system in which 1,000 or even more threads are fed to a warp beam, two or three defective threads can result in rejection of the goods for the entire warp beam.

DE 35 23 711 A1 discloses a device for the air entanglement of a plurality of traveling threads, in which the nozzle shapes are formed directly in the air-feed beam. It must be strongly doubted whether the necessary qualities of the air feeding channel and thread channel can be obtained with this device. This device has baffle plates which comprise profiled bars or profiled cones which, after threading, must be fastened by hand on the air-feed beam by magnetic mounting or the like. In addition to requiring some means for cutting off the air supply, handling of these traverses is scarcely feasible in actual practice. Furthermore, the danger of injuring the surface of the impact plate on which the threads are entangled is very great due to the continuous thread transport. Rejects and thread breakage are expected with this device.

The disclosures of the above-mentioned prior art materials are expressly incorporated by reference.

SUMMARY OF THE INVENTION

It is an object of the present invention to provide a device for air entanglement of a plurality of filaments which assures dependable threading of the filaments into a plurality of entangling nozzles, uniform feeding of compressed air, and uncomplicated closing and opening of the entangling nozzles via baffle plates.

This object may be achieved, in accordance with one aspect of the invention, by installing one or more entangling nozzles on a traverse which is movable with respect to the air-feed beam, and mounting the baffle plates which close the thread channels of the entangling nozzles in a fixed position.

According to other aspects of the advantageous developments of this invention, the entangling nozzles may be anchored via a compressed-air piston in the movable traverse, the free end of the compressed-air piston extending into the air-feed beam.

A receiving bushing having a chambered air space as well as an air inlet opening into which the free end of the compressed-air piston extends may be arranged in the air-feed beam. In this case, the compressed-air piston may have a blind hole which communicates with a lateral air inlet opening which is closed upon movement of the traverse in the direction towards the air-feed beam, thereby interrupting and the air feed, and by the reverse motion of the piston, the air inlet is opened and the air feed begun again.

The movement of the traverse may be effected pneumatically or automatically or manually, for instance via an eccentric device.

A compression spring is preferably arranged between the traverse and the air-feed beam for resisting movement of the traverse.

The baffle plates are held in stationary position by a holder, which in turn may be mounted on the air-feed beam. The baffle plates are so dimensioned that they close the thread channel of the entangling nozzle without covering the entire surface of the entangling nozzles, permitting easy access for insertion of the thread.

The traverse may be divided into a plurality of individual segments so that each of a plurality of entangling nozzles can be independently actuated.

In an embodiment wherein the air feed in the air-feed beam can be shut-off centrally, e.g. for insertion of the thread, the compressed-air piston may be provided with a continuously open air feed hole which extends into the air-feed beam.

In the textile industry, in particular in the field of warping systems, it is important for the threads to be inserted from the outside into open entangling nozzles, by means of a suction gun for example, by which the individual threads are held.

In order to satisfy this and other requirements, in a device in accordance with the present invention, all entangling nozzles can be opened at the same time for easy access from the direction of the operator. The entangling nozzles are installed on a movable traverse which is supported on the air-feed beam via compression springs which, in turn, are mounted on a compressed-air piston which is coupled to the traverse and the entangling nozzle. The compressed-air pistons open into the air-feed channel via a receiving bushing in which an O-ring is arranged for sealing. The compressed-air pistons are arranged such that, by the movement of the entire traverse, the air inlet and outlet openings can be closed so as to block the feeding of air during the insertion of the thread and then, after thread insertion, opened again to carry out the entangling process.

The movement of the traverse can be effected manually or automatically by, for instance, an eccentric device, but it is preferably effected by a pneumatic system. The baffle plates for the closing of the nozzles are arranged in a fixed position, for instance mounted on the air-feed beam. The entangling nozzles are therefore moved upward by the traverse towards the baffle plates to close them, and away from the baffle plates to open them. The baffle plates are dimensioned so that they can close the thread channel but do not block access to the entangling nozzle, in order to assure dependable access for the insertion of the thread.

Furthermore, according to another aspect, the device may provide a plurality of separate individual entangling nozzles with the traverse being correspondingly divided into individual segments.

As is known in these systems, the threads are spaced apart at a very small pitch. In addition to the advantages already described, the device of the invention can be further developed by providing the second side of the air-feed beam with a second movable traverse with a corresponding second set of entangling nozzles. They can be arranged in a staggered manner with respect to the entangling nozzles on the opposite side. In this way, twice as many threads can be worked.

Another advantage of the resiliently installed entangling nozzles is that they are urged upward by the spring action. In this way, although free to make an up-and-down oscillating movement, the entangling nozzles are applied by the springs against the stationary baffle plates in a flat, parallel manner.

According to another form of the invention, the air feed can be centrally opened and closed, for example, to turn off the flow in the entire air-feed beam for the thread insertion process. For this purpose, the compressed-air piston is provided with an open air-feed hole. The receiving bushing is replaced by a simple flange bushing in this embodiment.

The invention has the further advantage that its various embodiments can be retrofitted into any of the aforementioned prior art systems.

Other features and advantages of the present invention will become apparent from the following description of the invention which refers to the accompanying drawings.

BRIEF DESCRIPTION OF THE DRAWINGS

The device will be now explained further on basis of examples. In the drawings.

DETAILED DESCRIPTION OF EMBODIMENTS OF THE INVENTION

Figure 1:
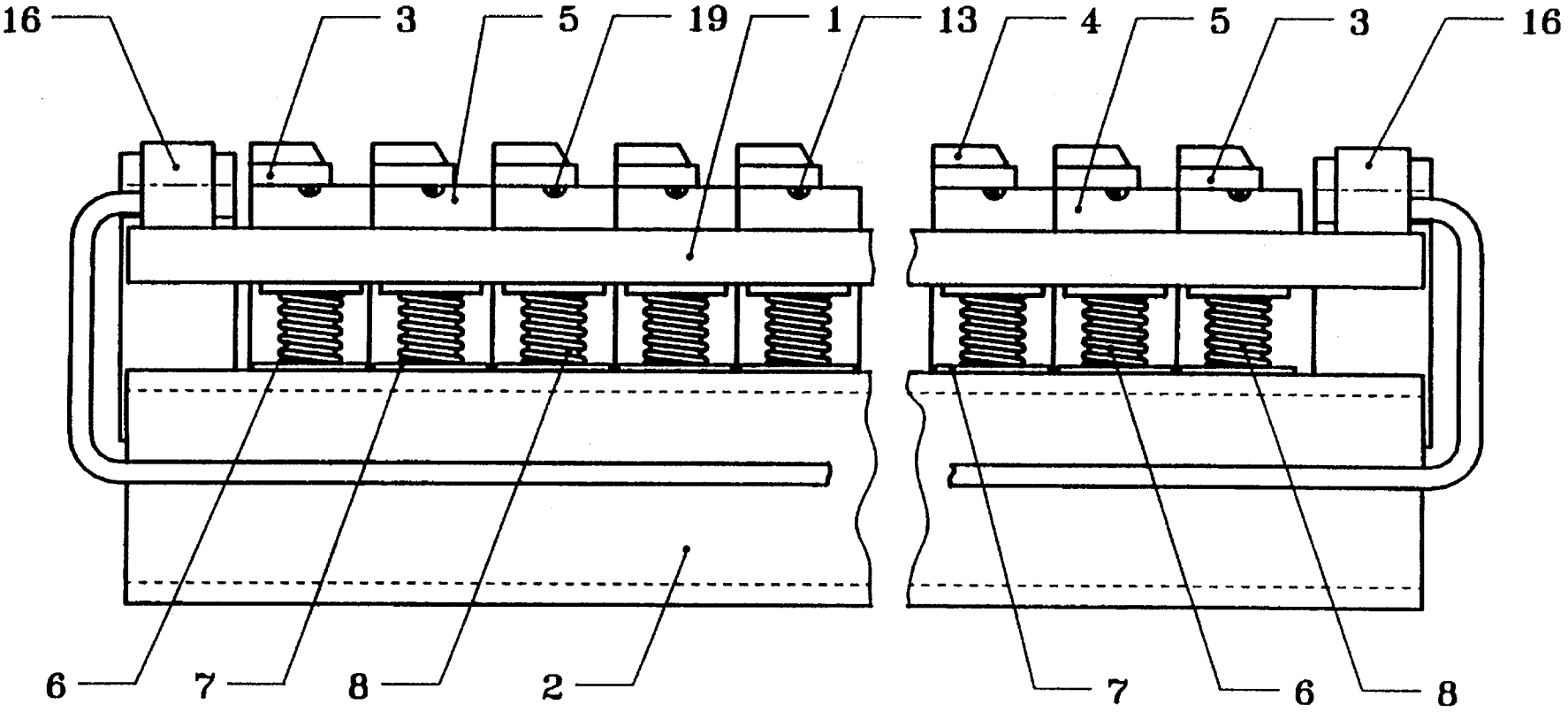
FIG. 1 shows a device with a plurality of entangling nozzles with the thread accommodated therein, and having an eccentric device for opening and closing the nozzles.

FIG. 1 shows a device according to a first embodiment of the invention, having a movable traverse 1 which is provided with a plurality of entangling nozzles 5. As shown, the device is in its operating position, so the entangling nozzles 5 are closed by the baffle plates 3 which are mounted in a fixed position, by the mounts 4, on the air feed beam 2. The threads 19 are located in the thread channels 13 of the entangling nozzles 5. The compression springs 8, which are borne by compressed-air pistons 6 (FIG. 3), are arranged between the traverse 1 and the air-feed beam 2. The compressed-air pistons 6 pass through receiving bushings 7, sealed by O-rings 18, into the air feed beam 2.

An eccentric device, which is diagrammatically shown at 16 in FIG. 1, can be used to commonly open and close all of the entangling nozzles 5 by moving the entire traverse 1 down and up, respectively.

Figure 2:
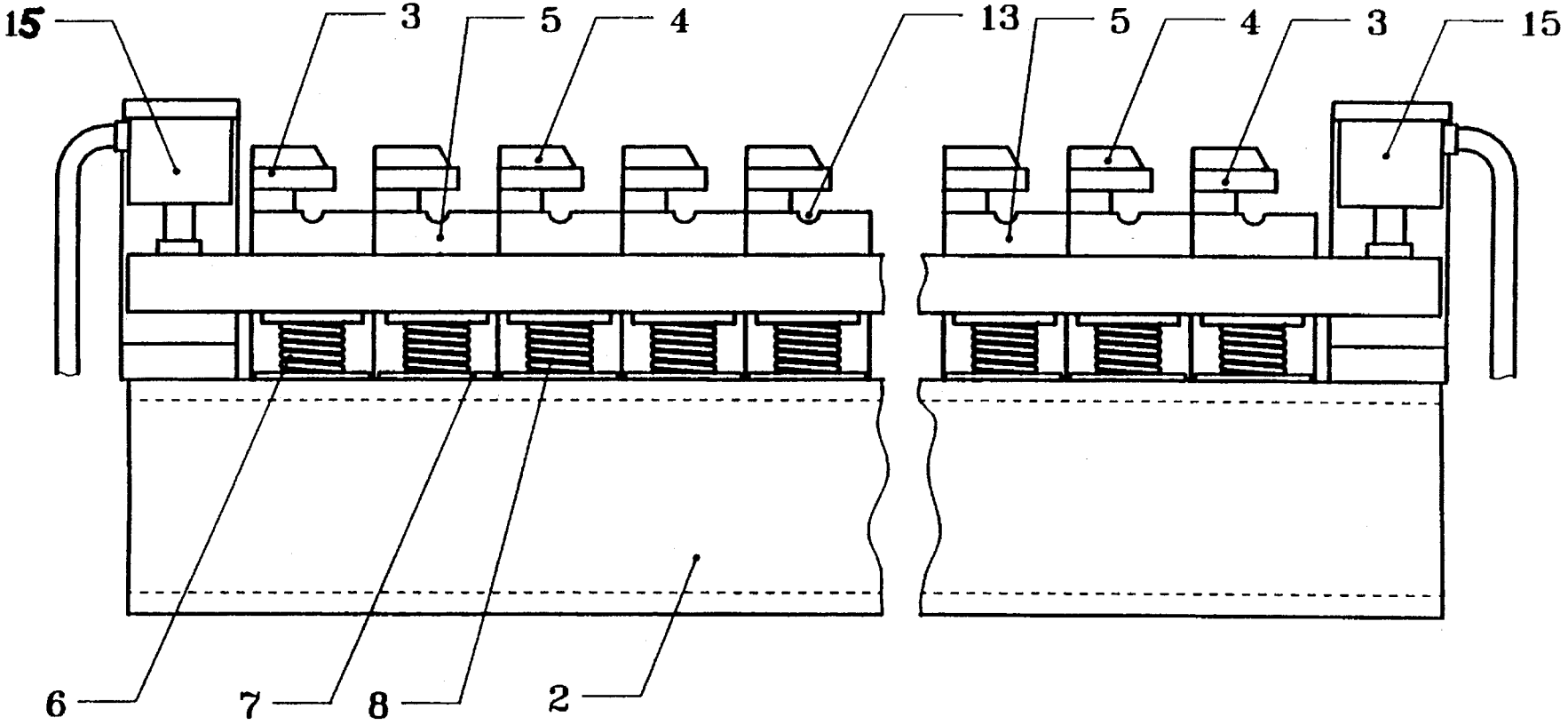
FIG. 2 shows a variation of the device of FIG. 1, in position for insertion of the thread, and having a pneumatic device for opening and closing the nozzles.

In FIG. 2, the entangling nozzles 5 are open for thread insertion. The stationary baffle plates 3 are in raised position, and are so dimensioned that there is sufficient clearance for thread insertion between each baffle plate 3 and the next entangling nozzle. In this embodiment, a pneumatic system 15, shown diagrammatically, is used compress the compression springs 8, which are disposed between the traverse 1 and the air-feed beam 2.

Figure 3:
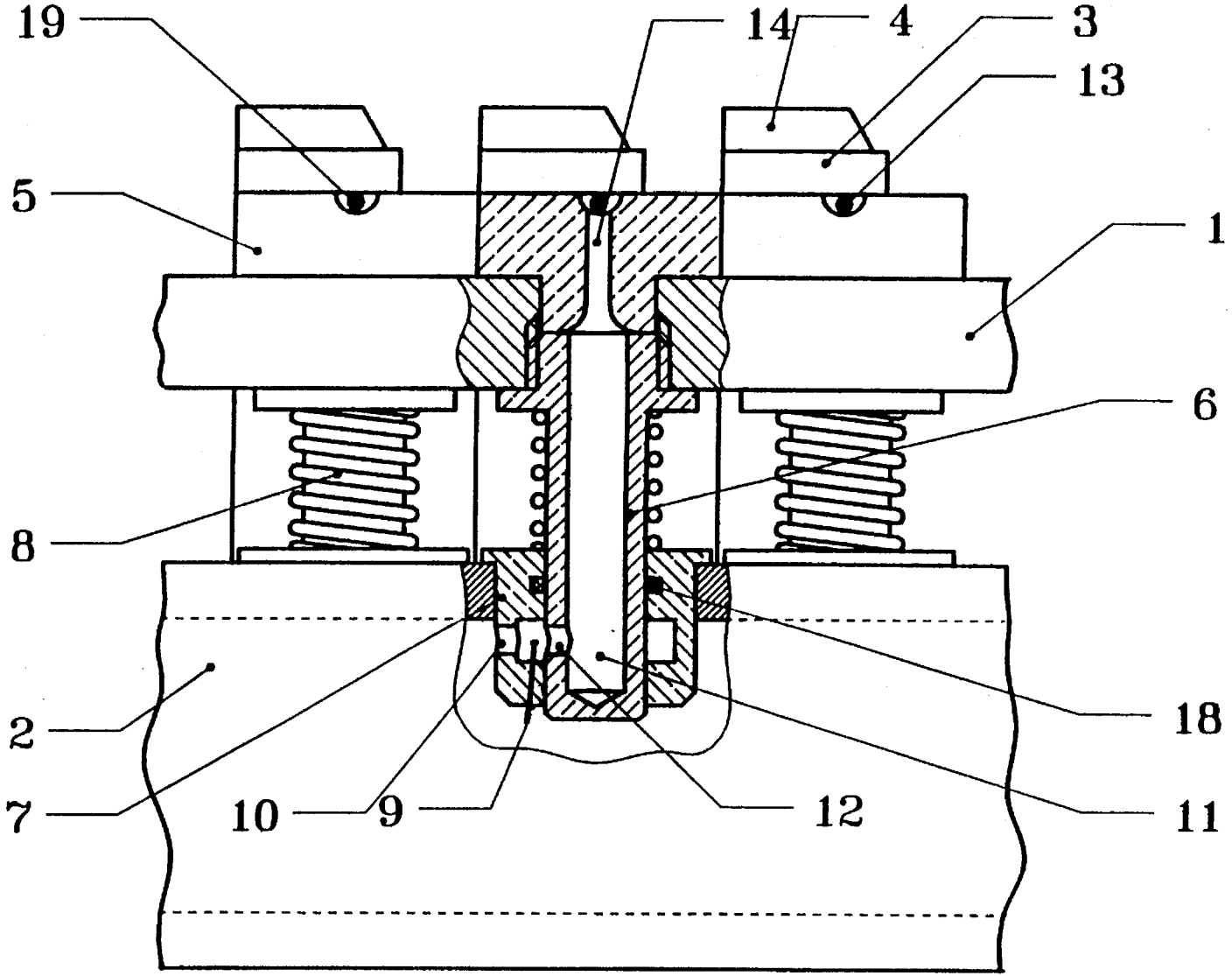
FIG. 3 shows a portion of the traverse, with one entangling nozzle being shown partially in cross-section.

FIG. 3 shows a portion of the traverse 1 with three entangling nozzles 5, one being shown in cross-section. In this view, it is assumed that the device is in operation, so the entangling nozzles 5 are closed. The baffle plates 3 are held in fixed position by the mounts 4. When the nozzles 5 are raised by the traverse 1, the baffle plates 3 close the thread channel 13 in which the thread 19 is contained. Compressed air passes to the compressed-air piston 6 via an air inlet opening 10 and a chamber 9 of a receiving bushing 7, and is conducted via an air inlet hole 12 in the piston 6 and a blind hole 11 to the entangling nozzle 5 where it reaches the thread through the blast opening 14. The compression spring 8, which is located between the traverse 1 and the air feed beam 2, exerts an upward pressure on the entangling nozzle 5 to hold it against the baffle plate 3.

Figure 4:
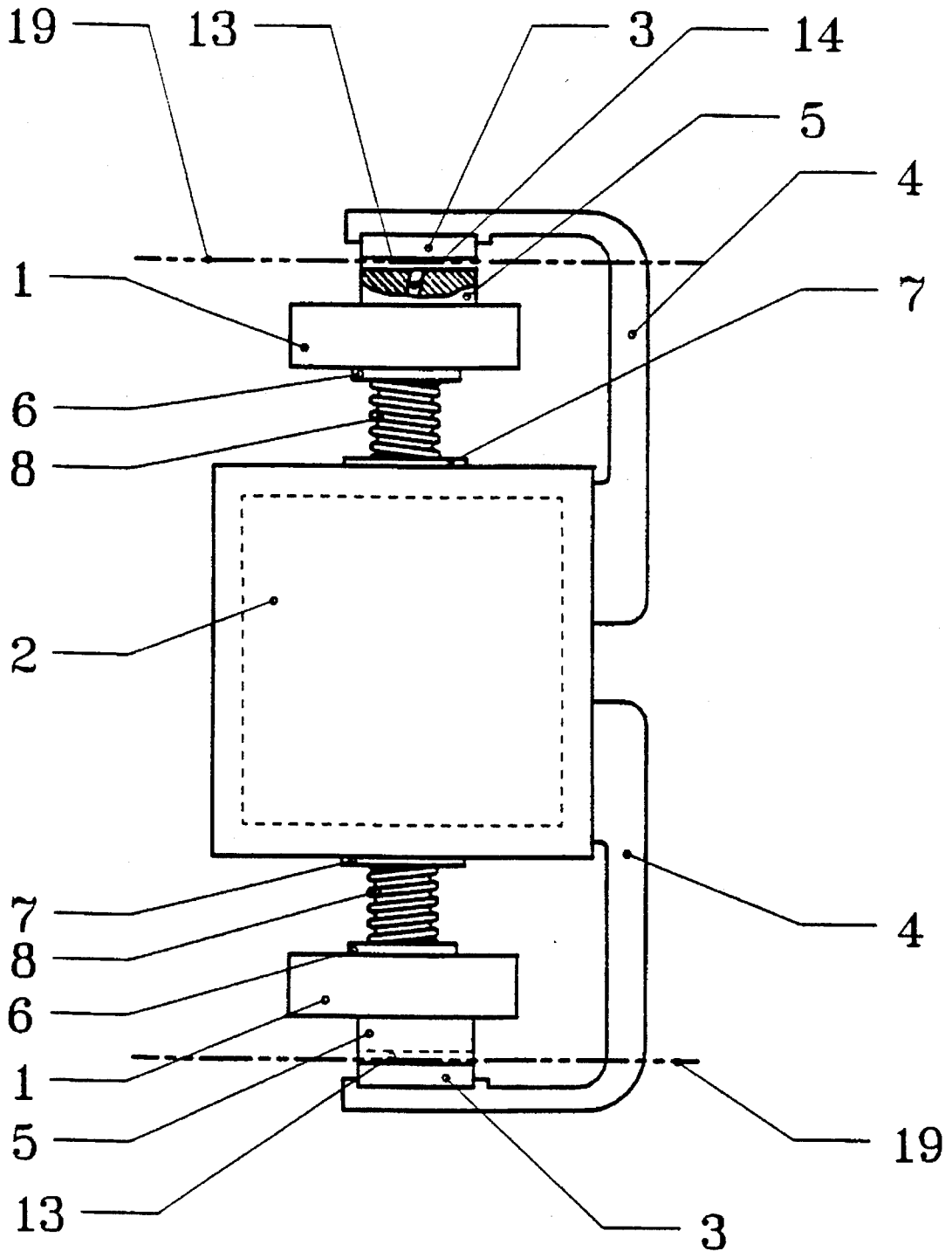
FIG. 4 shows a side view of a second embodiment of an entangling device, with upper and lower pairs of entangling nozzles.

FIG. 4 shows, in a side view, a second embodiment of the invention in which the air-feed beam 2 has pairs of entangling nozzles 5 on opposite sides thereof. Mounts 4 are fastened above and below the air-feed beam 2 to hold the baffle plates 3 fixed in position. They close the entangling nozzles 5 which are mounted on the traverse 1 which is movable against the force of the compression springs 8. The compressed-air pistons 6 extend through the receiving bushings 7 into the air feed beam 2. The threads 19 are contained in the thread channels 13 of the entangling nozzles 5 and are entangled by compressed air which passes through the blast hole 14.

Figure 5:
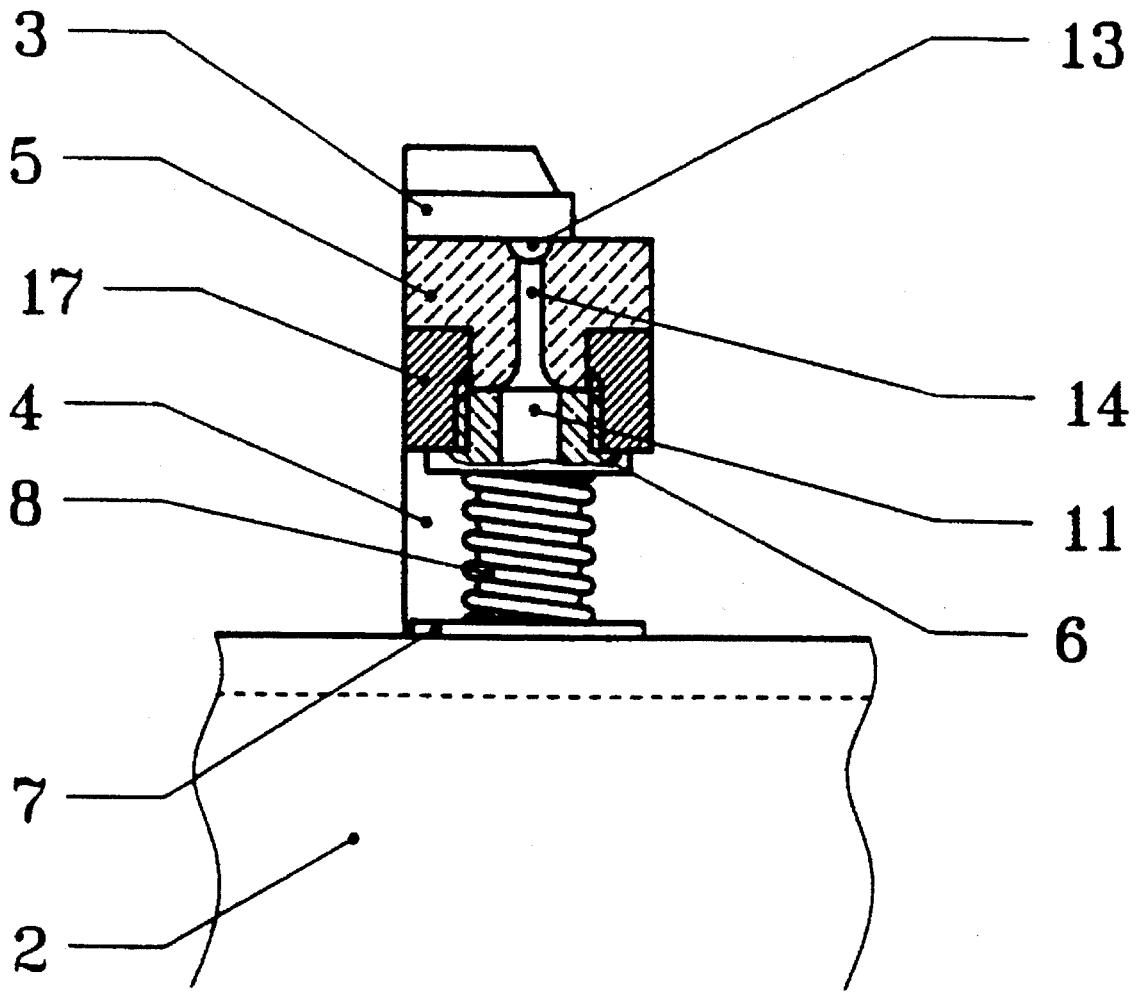
FIG. 5 shows a third embodiment of the invention, with a single entangling nozzle.

FIG. 5 shows an individual entangling nozzle according to a third embodiment of the invention. The traverse 1 is divided into individual segments 17 and thus forms the mount for the entangling nozzle 5. The baffle plate 3 is connected, fixed in position, to the air-feed beam 2 by the mount 4. The function of the entangling nozzle 5 is identical to that described in connection with FIG. 3.

Figure 6:
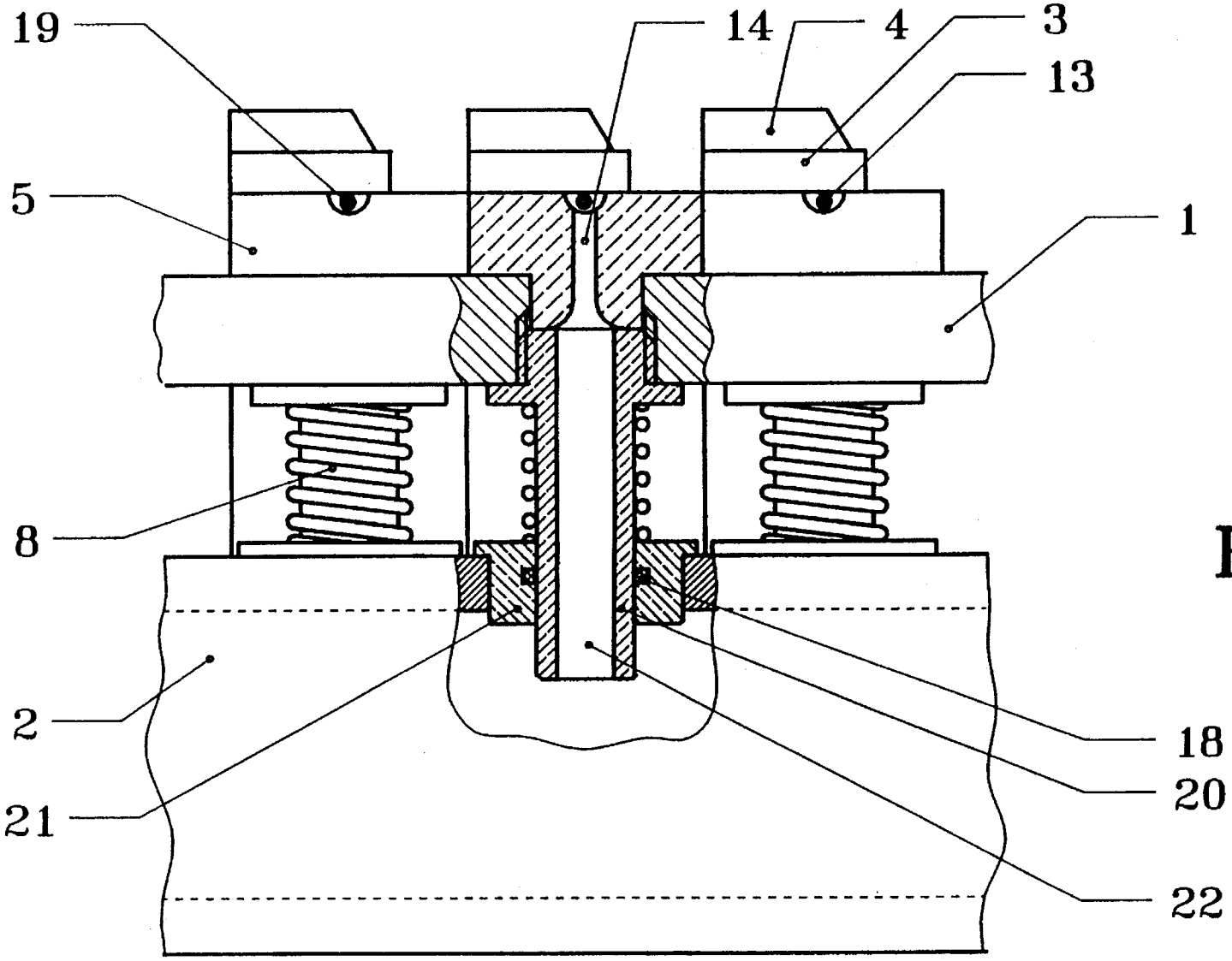
FIG. 6 shows a fourth embodiment of the entangling device, which is usable with central control of the air-feed.

FIG. 6 shows a fourth embodiment of the entangling nozzle which is adapted for use with a central air-feed cut-off device. The figure corresponds to FIG. 3, but the compressed-air piston 20 is provided with an air-feed hole 22 which is continuously open to the air-feed beam 2 and is guided by the flanged bushing 21.

Preferably, the entangling nozzles are easily removable and replaceable. They may be made of a friction-resistant and wear-resistant material, such as hardened steel or ceramics. Likewise, the baffle plates preferably can be easily detached from the holders and replaced, and made of an abrasion-resistant and wear-resistant material, for instance ceramics.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An entangling device for entangling filaments, comprising;

at least one entangling nozzle for receiving filaments and for supplying compressed air for entangling the filaments;

an air-feed beam for feeding the compressed air to the entangling nozzle;

a baffle plate for closing a thread channel of said entangling nozzle, and opening said thread channel to permit insertion of a thread, the baffle plate being mounted in stationary position relative to said air feed beam;

means for movably mounting the entangling nozzle for movement to and away from said baffle plate for closing and opening said thread channel, respectively.

2. A device as in claim 1, wherein said baffle plate is mounted in fixed position with respect to said air-feed beam, and said entangling nozzle is mounted movably with respect to said air-feed beam.

3. A device according to claim 2, wherein the baffle plate is arranged stationary via a holder, which is mounted on the air-feed beam.

4. A device as in claim 2, wherein said entangling nozzle is mounted on a traverse which is movable with respect to the air-feed beam.

5. A device according to claim 4, wherein the entangling nozzle and traverse are supported on the air feed-beam by a compressed-air piston, a free end of the compressed-air piston extending into the air-feed beam.

6. A device according to claim 5, wherein a compression spring is arranged between the traverse and the air-feed beam via the compressed-air piston of the entangling nozzle.

7. A device according to claim 4, wherein a compression spring is arranged between the traverse and the air-feed beam via the compressed-air piston of the entangling nozzle.

8. A device according to claim 4, further comprising a plurality of additional nozzles, said nozzle and said additional nozzles being commonly mounted on said traverse.

9. A device according to claim 8, wherein the traverse is divided into individual segments corresponding to said entangling nozzles so that each entangling nozzle can be moved independently.

10. A device according to claim 5, wherein a bushing is mounted on the air-feed beam and receives the compressed-air piston, the bushing having an air inlet within the air-feed beam, the compressed-air piston having an air inlet which coincides with said air inlet of said bushing when the traverse is positioned in the direction away from the air-feed beam for permitting air feed, and does not coincide with the air inlet of the bushing when the traverse is moved toward the air-feed beam for interrupting the air feed.

11. A device according to claim 5, wherein air feed to the air-feed beam can be shut-off centrally, the compressed-air piston being provided with a continuously open air feed hole within said air-feed beam.

12. A device according to claim 8, further comprising a second set of nozzles and a corresponding second traverse, arranged on a part of said air-feed beam away from said first-mentioned nozzle and additional nozzles.

13. A device according to claim 4, further comprising a pneumatic device for moving the traverse away from said baffle plate.

14. A device according to claim 4, further comprising an eccentric device for moving the traverse away from said baffle plate.

15. A device according to claim 14, wherein said eccentric device is operable manually.

16. A device according to claim 1, wherein the baffle plate is dimensioned so that it closes the thread channel of the entangling nozzle without covering the entire surface of the entangling nozzle and thereby permits access to the entangling nozzle for thread insertion.

* * * * *